United States Patent [19]

Tassara

[11] 4,382,004

[45] May 3, 1983

[54] PREPARATION OF MAGNESIUM ALKYLPHENATES AND THEIR USE AS DETERGENT-DISPERSANT ADDITIVES FOR LUBRICATING OILS

[75] Inventor: Jean-Pierre Tassara, Villeurbanne, France

[73] Assignee: Orogil, Courbevoie, France

[21] Appl. No.: 289,220

[22] Filed: Aug. 3, 1981

Related U.S. Application Data

[63] Continuation of Ser. No. 123,725, Feb. 22, 1980, abandoned.

[30] Foreign Application Priority Data

Mar. 9, 1979 [FR] France ..... 79 06060

[51] Int. Cl.[3] ..... C10M 1/10

[52] U.S. Cl. ..... 252/25; 252/49.7; 252/42.7

[58] Field of Search ..... 252/25, 49.7

[56] References Cited

U.S. PATENT DOCUMENTS

| | | | |
|---|---|---|---|
| 3,350,310 | 10/1967 | Herd et al. | 252/42.7 |
| 3,878,116 | 4/1975 | Rueckert | 252/33.4 |
| 3,932,289 | 1/1976 | King et al. | 252/42.7 |
| 3,966,621 | 6/1976 | Watkins et al. | 252/42.7 |
| 4,010,106 | 3/1977 | Rothert | 252/42.7 X |
| 4,016,093 | 4/1977 | Koft | 252/42.7 |
| 4,049,560 | 9/1977 | Dominey | 252/25 X |
| 4,212,752 | 7/1980 | Peditto et al. | 252/42.7 |

FOREIGN PATENT DOCUMENTS

| | | | |
|---|---|---|---|
| 2277145 | 1/1976 | France | 252/49.7 UX |

*Primary Examiner*—Paul F. Shaver

[57] ABSTRACT

A method of preparing magnesium alkylphenates comprising:

1. preparing a suspension of "active" magnesium oxide in methanol;
2. contacting said suspension with a mixture containing
   (a) an alkylphenol bearing one or more $C_6$–$C_{60}$ alkyl substituents;
   (b) a dilution oil;
   (c) and optionally a heavy alcohol of a boiling point of between 100° and 200° C., the ratio of number of mols of "active" magnesium oxide to number of recurrent phenolic OH units being between about 0.25 and 2; and
3. carbonating the resultant medium under pressure with carbon dioxide.

The magnesium alkylphenates thus obtained are suitable detergent-dispersant additives for lubricating oils in amounts of between about 1 and 8 percent of the weight of the oils.

15 Claims, No Drawings

PREPARATION OF MAGNESIUM ALKYLPHENATES AND THEIR USE AS DETERGENT-DISPERSANT ADDITIVES FOR LUBRICATING OILS

This is a continuation of application Ser. No. 123,725, filed Feb. 22, 1980, now abandoned.

BACKGROUND OF THE INVENTION

The present invention relates to a method of preparing magnesium alkylphenates, the products obtained by said method, and to their use as detergent-dispersant additives for lubricating oils.

U.S. Pat. Nos. 3,718,589 and 3,932,289 disclose that magnesium alkylphenates can be prepared from alkylphenols by using carbonated magnesium alcoholates as neutralizing or super-alkalinizing agents. Such methods are costly and difficult since the carbonated magnesium alcoholates require preparation from metallic magnesium.

French Pat. No. 2,277,145 (U.S. counterpart, Pat. No. 4,049,560) discloses that magnesium alkylphenates can be prepared by carbonating a mixture containing an alkylphenol, possibly a sulfurized alkylphenol, a sulfonic acid, an alcohol, magnesium hydroxide or active magnesia, as well as a promoter of the ammonium carboxylate type. Such a method does not employ an alkylphenol by itself, but a mixture of alkylphenol and sulfonic acid, which is easier to neutralize, and it requires the presence of a promoter.

Applicant has discovered a method which makes it possible to prepare magnesium alkylphenates by employing an alkylphenol alone (that is to say, not mixed with a sulfonic acid) and active magnesia, and not requiring the use of a promoter.

It is, accordingly, an object of the present invention to provide a process which avoids the disadvantages of the prior art processes.

It is also an object of the present invention to provide a process for the preparation of magnesium alkylphenates which avoids the use of a sulfonic acid and a promoter.

It is a further object of the present invention to provide a process for the preparation of magnesium alkylphenates by employing an alkylphenol alone with active magnesia.

Other objects will be apparent to those skilled in the art from the present description.

GENERAL DESCRIPTION OF THE INVENTION

The method of preparing magnesium alkylphenates which forms a part of the present invention comprises:

1. Preparing a suspension of "active" magnesium oxide in methanol, which suspension may contain up to 10 percent by weight of "active" magnesium oxide, referred to the weight of the methanol;

2. Contacting the said suspension with a mixture containing:

(a) an alkyl phenol bearing one or more $C_6$–$C_{60}$ alkyl substituents;

(b) a dilution oil;

(c) a heavy alcohol of a boiling point of between about 100° and 200° C., the ratio of the number of mols of "active" magnesium oxide to number of recurrent phenolic OH units being between about 0.25 and 2, the amount of dilution oil being between about zero and 140 percent by weight referred to the weight of alkyl phenol, and the molar ratio of heavy alcohol to "active" magnesium oxide being between about zero and 4, the said molar ratio being at least about 1.2, when the ratio of the number of mols of "active" magnesium oxide to the number of recurrent phenolic OH units is greater than about 0.75;

3. Carbonating the resultant medium under pressure by means of carbon dioxide.

Preferred conditions for practicing the process of the invention comprise:

(A) from about 5 to 10 percent by weight of "active" magnesium oxide, referred to the weight of methanol;

(B) a ratio of number of mols of "active" magnesium oxide to number of recurrent phenolic OH units of between about 0.5 and 1;

(C) from about 20 to 75 percent by weight of dilution oil, referred to the weight of alkylphenol;

(D) a molar ratio of heavy alcohol to "active" magnesium oxide of at least about 1.5, when the ratio of the number of mols of "active" magnesium oxide to number of recurrent phenolic OH units is greater than about 0.75;

(E) the carbonation operation is carried out for at least about 4 hours under a pressure of between about 3 and 30 kg. per square centimeter, and more particularly between about 5 and 15 kg. per square centimeter, with an amount of $CO_2$ corresponding, within about 30 percent by weight, to that amount which can be completely absorbed by the medium; in general, this amount of $CO_2$ corresponds substantially to the amount which can be completely absorbed.

There is designated by the term "active" magnesium oxide, that magnesium oxide which can be obtained by the mild calcining of basic magnesium carbonate, for instance, at a temperature on the order of about 500° to 700° C., for at least about 3 hours; the specific surface of this type of oxide is greater than about 80 square meters per gram and generally greater than about 100 square meters per gram.

By the term "alkyl phenol" there are designated both the non-sulfurized alkyl phenols and the sulfurized alkyl phenols. Among the alkyl phenols which can be used are included those bearing one or more $C_9$–$C_{15}$ substituents, particularly the nonyl, decyl, dodecyl, and tetradecyl phenols, possibly sulfurized.

Among the dilution oils which can be used are, preferably, paraffin oils, such as 100 neutral oil; the naphthene or mixed oils may also be suitable.

Among the preferred heavy alcohols which can be used are isobutanol, hexanol, and 2-ethyl hexanol.

The operation of suspending the "active" magnesium oxide in the methanol takes place in favorable manner at ordinary temperature. The contacting and carbonating operations can be carried out at a temperature of between about zero and 40° C., and preferably between about 15° and 30° C.

The above-described operations can possibly be followed by a treatment with water, particularly when a ratio of number of mols of "active" magnesium oxide to number of recurrent phenolic OH units of more than 1 has been employed and if it is desired to decrease the viscosity of the resultant product. This treatment with water can be carried out in conventional fashion, using 1 to 2 mols of water per mol of "active" magnesium oxide involved.

The present invention also includes among its objects a variant embodiment of the method described above, which variant consists in precarbonating, under pressure, the suspension of "active" magnesium oxide in methanol before contacting it with the alkyl phenol/-heavy-alcohol mixture, carrying out the contacting under pressure, and then terminating the carbonation.

The precarbonation operation can be carried out at a pressure of between about 3 and 30 kg. per square centimeter, and preferably between about 5 and 15 kg. per square centimeter, at a temperature of between zero and about 40° C., and, preferably, between about 15° and 30° C. This operation generally takes at least about 3 hours.

The contacting and final carbonation operations are desirably carried out at a pressure of between about 3 and 30 kg. per square centimeter, and preferably between about 5 and 15 kg. per square centimeter, at a temperature between zero and about 40° C., and preferably between about 15° and 30° C.

The precarbonation and final carbonation operations together generally take at least about 4 hours.

Another object of the present invention is the magnesium alkylphenates obtained by the method and the variant thereof which have been described above, as well as the use of said alkylphenates as detergent-dispersant additives for lubricating oils. The amount of alkylphenate to be added to gasoline crankcase oils is generally on the order of about 1 to 4 percent by weight. In the case of diesel crankcase oils, the amount is generally on the order of about 1 to 8 percent, by weight.

Lubricating oils which can be improved in this manner may be selected from among a very large number of lubricating oils such as the naphthene-base, paraffin-base and mixed-base lubricating oils and other hydrocarbon lubricants, for example, lubricating oils derived from coal products and synthetic oils, such as, alkylene polymers, polymers of the alkylene-oxide type and their derivatives, including the alkylene oxide polymers prepared by polymerizing alkylene oxide in the presence of water or alcohols, for example, ethyl alcohol, the dicarboxylic acid esters, liquid esters of liquid acids of phosphorus alkylbenzenes and dialkyl benzenes, polyphenyls, alkylbiphenyl ethers, and polymers of silicon.

Additional additives may also be present in the said lubricating oils along with the detergent-dispersants obtained in accordance with the method of the invention. Mention may be made, for instance, of anti-oxidant and anti-corrosion additives, ashless dispersant additives, etc.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLE 1

The alkylphenol used was presulfurized paradodecyl phenol (A) containing 11.5 percent sulfur (obtained by sulfurization with sulfur).

The "active" magnesium oxide (B) used had a specific surface of 145 square meters per gram and a 90 percent MgO purity.

The molar ratio of MgO to phenolic OH used was 0.5.

The amount of active MgO was 9 percent, referred to the methanol.

The amount of dilution oil was 68.3 percent, referred to the alkylphenol.

Into a one-liter reactor resistant to pressures of 35 kg. per square centimeter and equipped with an agitator system there were introduced:

(A) 146 g. of sulfurized paradodecyl phenol (A) (namely, about 0.5 mol of phenolic OH);

(B) 100 g. of Neutral 100 dilution oil.

A suspension of 11 g. of active magnesium oxide (B) (namely, 0.25 mol) was prepared separately in 120 g. of methanol and this suspension was added to the previous mixture.

The mixture thus obtained was then carbonated at 20° C., with agitation, introducing carbon dioxide into the reactor under a pressure of 10 kg. per square centimeter for 8 hours. At the end of this time, the apparatus was returned to atmospheric pressure and the methanol was eliminated by distillation, gradually increasing the temperature up to 180° C.

In this way, there was obtained 260 g. of a sediment-free magnesium alkylphenate containing 2.3 percent of magnesium and 2 percent of $CO_2$, the rate of apparent superalkalinization of which was equal to 1 percent and which had a TBN of 110 mg. KOH per gram (TBN—Total Basic Number—ASTM Standard D 2896).

EXAMPLE 2

Comparative Example

Example 1 was repeated, but without previously preparing the suspension of magnesium oxide in methanol, introducing all the components of the mixture without any particular precautions.

After 8 hours of carbonation under a pressure of 10 kg. per square centimeter and after elimination of the methanol, there was obtained mixture still containing in suspension practically all the magnesium oxide introduced, which made the product unfilterable.

EXAMPLE 3

The operation described in Example 1 was repeated in the presence of an amount of "active" MgO corresponding to 5 percent by weight of the methanol.

The suspension of "active" MgO was thus formed of 11 g. of active MgO (namely, 0.25 mol) in 220 g. of methanol.

There was obtained 270 g. of sulfurized magnesium alkylphenate having a TBN of 90 mg., containing 2 percent magnesium and 1.8 percent $CO_2$.

EXAMPLE 4

The molar ratio of active MgO to phenolic OH used was 1.

The amount of active MgO was 8.8 percent, referred to the weight of methanol.

The amount of dilution oil was 68.3 percent, referred to the alkylphenol.

The molar ratio of hexanol to active MgO was 3.

There was introduced:

(1) 146. g. of sulfurized paradodecyl phenol (A) (namely, about 0.5 mol of phenolic OH);

(2) 100 g. of 100 Neutral dilution oil; and (3) 150 g. of n-hexanol.

A suspension was prepared of 22 g. of active magnesium oxide (B) (i.e., 0.5 mol) and 250 g. of methanol, and this suspension was added to the preceding mixture.

The resulting mixture was carbonated for 10 hours at room temperature under a carbon dioxide pressure of 10 kg. per square centimeter. At the end of this time, the mixture was returned to atmospheric pressure and the alcohols were eliminated by distillation, heating the product up to 180° C. under vacuum in order completely to eliminate the hexanol.

There were thus obtained 270 g. of crude product, which was filtered over 20 g. of filter earth, using 20 g. of additional 100 Neutral oil.

In this way, there were recovered 270 g. of finished product, having a TBN of 170 mg., and containing 3.7 percent of magnesium and 3.5 percent of $CO_2$, while 20 g. of crude product remained absorbed on the filter cake.

EXAMPLE 5

The molar ratio of active MgO to phenolic OH was 0.85.

The molar ratio of hexanol to acive MgO was 1.5.

The amount of active MgO was 8.6 percent, referred to the weight of methanol.

The amount of dilution oil was 68.3 percent, referred to the alkylphenol.

There were introduced:

(1) 146 g. of sulfurized paradodecyl phenol (A) (namely, about 0.5 mol of phenolic OH);

(2) 100 g. of 100 Neutral dilution oil; and (3) 65 g. of n-hexanol.

A suspension was prepared of 19 g. of active magnesium oxide (B) (namely, 0.425 mol) in 220 g. of methanol and this suspension was added to the preceding mixture.

The resulting mixture was carbonated for 10 hours at room temperature under a carbon dioxide pressure of 12 kg. per square centimeter. It was returned to atmospheric pressure and the volatile products were distilled off by heating up to 180° C. under vacuum. There were recovered 270 g. of a crude product, which was filtered over 20 g. of filter earth, using 20 g. of additional dilution oil.

There were thus obtained 273 g. of finished product, having a TBN of 160 mg. and containing 3.4 percent magnesium and 3 percent $CO_2$.

EXAMPLE 6

The molar ratio of active MgO to phenolic OH was 0.5.

The amount of active MgO was 8.66 percent, referred to the weight of methanol.

The amount of dilution oil was 45.5 percent, referred to the alkylphenol.

There were introduced:

(1) 176 g of sulfurized paradodecyl phenol (A) (namely, about 0.6 mol of phenolic OH); and (2) 80 g. of 100 Neutral dilution oil.

A suspension was prepared of 13 g. of active magnesium oxide (B) (namely, 0.3 mol) in 150 g. of methanol, and this suspension was added to the preceding mixture.

The resultant mixture was carbonated for 8 hours at room temperature under a carbon dioxide pressure of 12 kg per square centimeter. It was brought back to atmospheric pressure and the methanol distilled, thus recovering 278 g. of a crude product, which was filtered using 20 g. of earth and 20 g. of oil. There were recovered 276 g. of magnesium alkylphenate having a TBN of 110 mg. and containing 2.3 percent magnesium and 1.9 percent $CO_2$.

EXAMPLE 7

The operation described in Example 4 was repeated, but with precarbonation of the suspension of 22 g. of magnesia (B) in 250 g. of methanol for 5 hours under a pressure of 10 kg per square centimeter at room temperature.

At the end of this time, the mixture of alkylphenol (A) oil and n-hexanol was introduced under pressure.

The carbonation was continued for 2 hours.

At the end of this time, the mixture was returned to atmospheric pressure and the alcohols were eliminated by distillation. In this way, there were recovered 272 g. of crude product which, after filtration, gave 273 g. of finished product (C) having a TBN of 185 mg. and containing 4 percent magnesium and 3.5 percent $CO_2$. Knowing that 20 g. of dilution oil were added for the filtration and that 19 g of crude product remain absorbed on the filter cake, one can see that the dispersion of the magnesium was practically quantitative.

EXAMPLE 8

The product (C) obtained in Example 7 was subjected to a treatment with water in order to increase its fluidity. For this, 50 g. of magnesium alkylphenate (C) were mixed with 50 g. of n-hexanol and 4 g. of water at room temperature.

The mixture was then heated to 180° C. under a pressure of 20 mm. Hg. to eliminate the volatile products introduced.

In this way, there were recovered 49.5 g. of a very fluid product which could be handled and transported without problem at room temperature. It had a TBN of 185 mg. and contained 4 percent magnesium and 2.9 percent $CO_2$.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A method of preparing magnesium alkyl phenates comprising:

(A) preparing a suspension of active magnesium oxide in methanol, said suspension containing up to about 10 percent by weight of active magnesium oxide, referred to the weight of the methanol;

(B) contacting at a temperature between about 0° and 40° C. said suspension with a mixture consisting essentially of:

(a) an alkyl phenol having at least one $C_6$–$C_{60}$ alkyl substituent, (b) a dilution oil, and (c) a heavy alcohol of a boiling point of between about 100° and 200° C. that is not a diol, the ratio of the number of mols of active magnesium oxide to the number of recurrent phenolic OH units being between about 0.25 and 2, the amount of dilution oil being between about 0 and 140 percent by weight, referred to the weight of alkyl phenol, and the molar ratio of heavy alcohol to active magnesium oxide being between about 0 and 4, the said molar ratio being at least 1.2 when the ratio of the number of active magnesium oxide mols to the number of recurrent phenolic OH units is greater than about 0.75;

(C) and carbonating the resultant medium under pressure with carbon dioxide at a temperature between about 0° and 40° C.

2. A method according to claim 1, wherein there are employed:

(A) from about 5 to 10 percent by weight of active magnesium oxide, referred to the weight of methanol;

(B) a ratio of number of mols of active magnesium oxide to number of recurrent phenolic OH units of between about 0.5 and 1;

(C) from about 20 to 75 percent by weight of dilution oil, referred to the weight of alkylphenol; ;p1 (D) a molar ratio of heavy alcohol to active magnesium oxide of at least 1.5 when the ratio of the number of mols of active magnesium oxide to number of recurrent phenolic OH units is greater than about 0.75; and (E) the carbonation operation is carried out with an amount of $CO_2$ corresponding, within about 30 percent by weight, to that which can be completely absorbed by the medium.

3. A method according to claim 1 or claim 2, wherein the carbonation operation is carried out for at least about 4 hours at a pressure of between about 3 and 30 kg. per square centimeter.

4. A method according to claim 1 or 2, wherein the carbonation operation is carried out at a pressure of between about 5 and 15 kg. per square centimeter, at a temperature of between about 15° and 30° C., and with an amount of $CO_2$ corresponding substantially to that which can be completely absorbed.

5. A method according to claim 1, wherein the suspension of active magnesium oxide in methanol is precarbonated under pressure before contacting it with the mixture of alkyl phenol with oil and heavy alcohol, by contacting under pressure, and by terminating the carbonation.

6. A method according to claim 5, wherein the pressure is between about 3 and 30 kg. per square centimeter and the temperature is between about zero and 40° C.

7. A method according to claim 6, wherein there are employed a pressure of between about 5 and 15 kg. per square centimeter and a temperature of between about 15° and 30° C., and the precarbonation operation lasts at least about three hours, and the precarbonation and carbonation operations together last at least about 4 hours.

8. A method according to claim 1, wherein the alkyl phenol bears at least one $C_9$–$C_{15}$ alkyl substituent and is sulfurized.

9. A method according to claim 1, wherein the heavy alcohol used is a member selected from the class consisting of isobutanol, hexanol, or 2-ethyl hexanol.

10. A method according to claim 1, wherein the carbonation operation is followed by a treatment with about 1 to 2 mols of water per mol of active magnesium oxide when the ratio of the number of mols of active magnesium oxide to the number of recurrent phenolic OH units is greater than about 1.

11. A lubricating oil additive as obtained by the method of claim 1.

12. A detergent-dispersant additive for lubricating oils, obtained by the method defined by claim 1.

13. A novel lubricating composition, having desirable detergent and dispersion properties, comprising an oil containing between about 1 and 8 percent by weight of a novel lubricant additive composition according to claim 12.

14. A gasoline engine oil, having desirable detergent and dispersion properties, containing between about 1 and 4 percent by weight of a novel lubricant additive composition according to claim 12.

15. A novel diesel engine oil having desirable detergent and dispersion properties containing between about 1 and 8 percent by weight of a novel lubricant additive composition according to claim 12.

* * * * *